United States Patent [19]

Duifhuis et al.

[11] 4,384,335

[45] May 17, 1983

[54] METHOD OF AND SYSTEM FOR DETERMINING THE PITCH IN HUMAN SPEECH

[75] Inventors: Hendrikus Duifhuis; Leonardus F. Willems; Robert J. Sluyter, all of Eindhoven, Netherlands

[73] Assignee: U.S. Philips Corporation, New York, N.Y.

[21] Appl. No.: 347,763

[22] Filed: Feb. 11, 1982

Related U.S. Application Data

[63] Continuation of Ser. No. 99,296, Dec. 3, 1979.

[30] Foreign Application Priority Data

Dec. 14, 1978 [NL] Netherlands ..... 7812151

[51] Int. Cl.[3] ..... G10L 1/00

[52] U.S. Cl. ..... 364/513; 179/1 SC

[58] Field of Search ..... 179/1 SA, 1 SB, 1 SC, 179/1 SD; 364/513, 724, 725

[56] References Cited

U.S. PATENT DOCUMENTS

| | | | |
|---|---|---|---|
| 4,004,096 | 1/1977 | Bauer et al. | 179/1 SC |
| 4,059,725 | 11/1977 | Sakoe | 179/1 SD |
| 4,060,694 | 11/1977 | Suzuki et al. | 179/1 SD |
| 4,075,423 | 2/1978 | Martin et al. | 179/1 SC |
| 4,161,625 | 7/1979 | Katterfeldt et al. | 179/1 SC |
| 4,181,821 | 1/1980 | Perz et al. | 179/1 SB |

OTHER PUBLICATIONS

L. Rabiner et al., "A Comparative Performance etc.", IEEE Trans. Acoustics, Sp. and Sig. Proc., Oct. 1976, pp. 399–418.

G. White et al., "Speech Recognition Experiments etc.", IEEE Trans. Acoustics, Sp. and Sig. Proc., Apr. 1976, pp. 183–188.

*Primary Examiner*—Emanuel S. Kemeny

*Attorney, Agent, or Firm*—Thomas A. Briody; William J. Streeter; Edward W. Goodman

[57] ABSTRACT

Method of and arrangement for the determination of the pitch of speech signals in a system of speech analysis, wherein sequences of significant peak positions of the amplitude spectrum of a speech signal are derived (13) from time segments of the speech signal by means of a discrete Fourier transform (12). In order to reduce the influence of noise signals and noise components, respectively, in the amplitude spectrum the significant peak positions are compared with different masks (15), which have apertures at harmonic distances of the associated fundamental tone. The mask which matches the sequence of significant peak positions best is selected (20). A probable value for the pitch is now computed with the harmonic numbers now known of the significant peak positions which are located in apertures of the selected mask. The mean square error between these significant peak positions and the corresponding harmonics of the finished tone can be used as a criterion (21).

10 Claims, 11 Drawing Figures

METHOD OF AND SYSTEM FOR DETERMINING THE PITCH IN HUMAN SPEECH

This is a continuation of application Ser. No. 099,296, filed Dec. 3, 1979.

BACKGROUND OF THE INVENTION

A.(1). Field of the Invention

The invention relates to a speech analysis system of a type wherein the amplitude spectrum of a speech signal is analyzed by regularly selecting time segments of the speech signal, by determining from each time segment a sequence of spectrum components which constitute the discrete Fourier transform of samples of the speech signal and by deriving in each time segment the positions of the significant peaks in the spectrum from the sequence of spectrum components.

The significant peak positions constitute the input data for a subsequent section of the speech analysis system for determining the pitch of the speech signal.

A(2). Description of the Prior Art

A speech analysis system which utilizes a FFT-transform and is of the type described sub A(1) is disclosed in IEEE Transactions on Acoustics, Speech and Signal Processing, Vol. ASSP, No. 4, August 1978, pp. 358–365. Therein the pitch is determined from the spacings between the peaks in the spectrum.

An article in Philips Technical Review, Vol. 5, No. 10, October 1940, pp. 286–294 shows already that the pitch is not correlated with the spacing between the harmonics but with the periodicity of the collective mode of oscillation of the component harmonics.

In the thesis by E. de Boer entitled: On the "residue" in hearing, University of Amsterdam, 1956, a m.s.e. (mean-square-error) criterion is used to determine a probable value of the pitch associated with a sequence of spectrum components of which the so-called "harmonic numbers" are known, which are the numbers of the nearest harmonics of the fundamental tone.

In an article in the Journal of the Acoustic Society of America, Vol. 54, no. 6, June 1973, pages 1496–1516, it is shown that the above-mentioned m.s.e. criterion and the "maximum likelihood" criterion developed in this article and based on psycho-physical phenomena result in the same estimate of the pitch.

In the analysis of speech signals originating from sources such as telephone lines not only the problem occurs that the fundamental tone itself may be absent but also that noise components are introduced, which may considerably affect the result of pitch determination.

SUMMARY OF THE INVENTION

It is an object of the invention to provide a speech analysis system for the determination of the pitch of speech signals, which is insensitive to the presence of noise signals and which requires a smaller number of computations than in the case an error must be computed for every possible sequence of harmonic numbers.

In a system of speech analysis of the present type this object is accomplished by means of the method which comprises the following steps:

the selection of a value for the pitch and the determination of a sequence of consecutive integral multiples of this value and the determination of intervals around this value and the multiples thereof, these intervals defining a mask having apertures in situ of an interval, harmonic numbers corresponding to the multiplication factors in the said multiples being associated with the apertures;

the determination of the significant peak positions coinciding with a mask aperture;

the computation of a quality figure in accordance with a criterion indicating the degree to which the significant peak positions and the mask apertures match;

the repetition of the preceding steps for consecutive higher values of the pitch until a predetermined highest value, resulting in a sequence of quality figures associated with these pitch values;

the selection of the value of the pitch having the highest quality figure, of which the associated mask constitutes a reference mask;

the association of the harmonic numbers of the apertures of the reference mask with the significant peak positions coinciding with these apertures, these harmonic numbers characterizing the locations of these peak positions in a sequence of harmonics of a same fundamental tone; and the determination of a probable value for the pitch, in such a way that the deviations between the last-mentioned significant peak positions and the corresponding multiples of the probable value having the same harmonic numbers are as small as possible.

The value of the pitch having the highest quality figure itself can be used for an estimation of the real pitch, in which case the last three steps of the method are reduced to one step. A more accurate estimation is, however, obtained by utilizing an optimization, using the m.s.e criterion, in the last step.

SHORT DESCRIPTION OF THE FIGURES

DESCRIPTION OF THE PREFERRED EMBODIMENT

Figure 1:
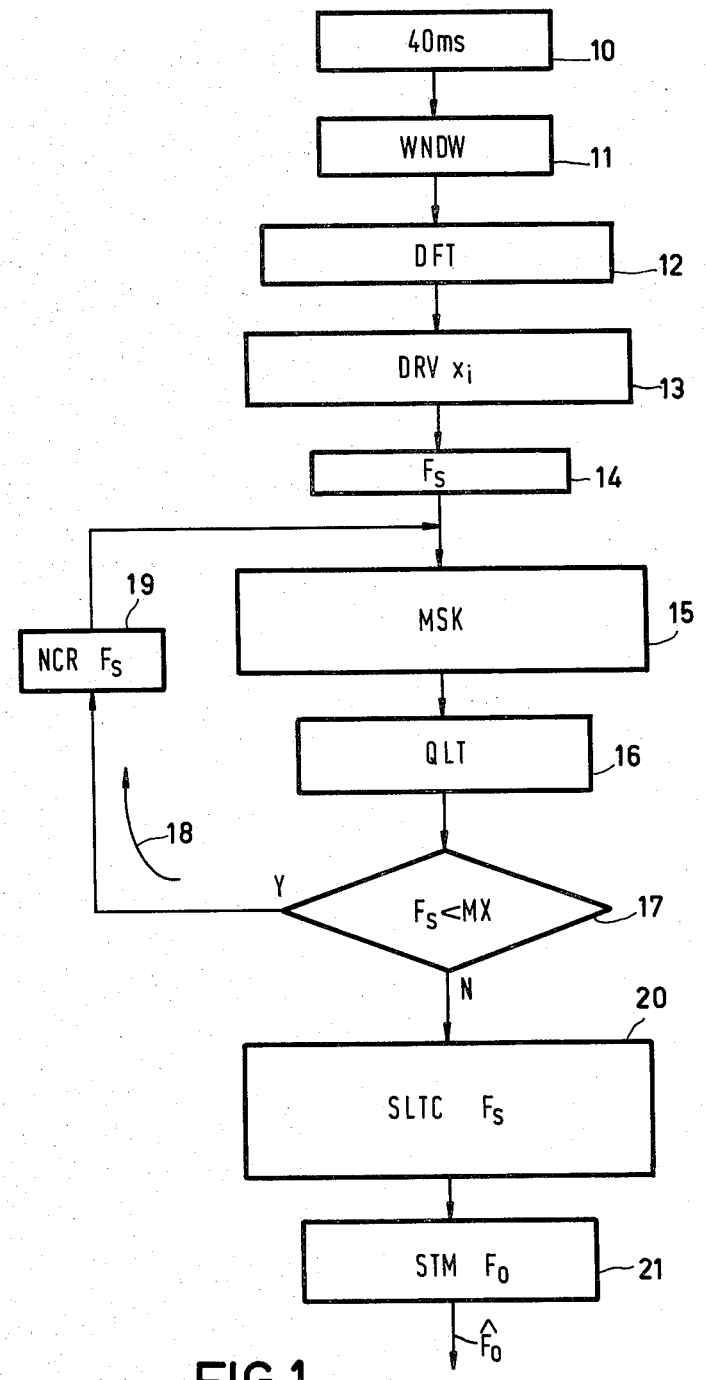
FIG. 1 is a schematic flow chart illustrating the sequence of operations in accordance with the practice of the speech analysis system according to the invention.

In the present speech analysis system a first object is the formation of a so-called "short-time" amplitude spectrum of a speech signal, which furnishes a running picture of the amplitude spectrum.

Time segments having a duration of 40 ms are taken from the sampled speech signal. This function is represented by block 10, bearing the inscription 40 ms. The next operation is the multiplication of each speech signal segment by a so-called "Hamming window," which function is represented by block 11, bearing the inscription WNDW.

Thereafter the samples of the speech signal segment are subjected to a 256 point Fourier transform as represented by block 12, bearing the inscription DFT.

In a following operation the amplitudes of 128 spectrum components are determined from the 256 real and imaginary values produced by the DFT. The significant peak positions $x_i$, which represent the locations of the peaks in the spectrum are derived from these spectrum components. These functions are represented by block 13, bearing the inscription DRV $x_i$.

In the next step of the process the pitch is assumed to have a value $F_s$ as represented by block 14.

Intervals are defined around this initial value and around a plurality of consecutive integral multiples thereof. These intervals are considered to be apertures in a mask in the sense that a component frequency value, $X_i$ which coincides with an aperture will be passed by the mask. In this conception the mask functions as a kind of sieve for frequency values. These operations are represented by block 15, bearing the inscription MSK.

Numbers, which are denoted as harmonic numbers and correspond to the multiplication factors of the relevant multiples of the selected value of the pitch are associated with the apertures of a mask.

The degree to which the significant peak positions $x_i$ and the apertures of the mask match is determined in a following operation. If few significant peak positions are passed by the mask then there is clearly a poor match. If, on the other hand, many of the peak positions are passed but many apertures in the mask do not pass significant peak positions because they are not present in that location, then there is also a poor match.

It is possible to find a proper criterion to express the degree of matching in a quality figure, as will be further explained hereinafter. Let it suffice at this point of the description to say that a suitable quality figure is computed for the mask. This operation is represented by block 16, bearing the inscription QLT.

In the decision diamond 17 a check is made whether the value $F_s$ selected for the pitch is below a given maximum value: $F_s < MS$. If this is the case the Y-branch of diamond 17 is followed, resulting in a loop 18 to block 15. In this loop the value of $F_s$ is increased in a certain manner: either by a given amount or by a given percentage. This function is represented by block 19, bearing the inscription NCR $F_s$.

The result of the presence of decision diamond 17 is that the operations, which are represented by the blocks 15 and 16 are continuously repeated for always new values of $F_s$ until $F_s$ attains the maximum value MX. When this is the case, the N-branch is followed and loop 18 is left.

The next operation in the present system of speech analysis consists in selecting the mask or the value $F_s$ of the pitch whose quality figure has the highest value. This function is represented by block 20 bearing the inscription SLCT $F_s$.

In the present system of speech analysis an accurate estimation is thereafter made in two steps of the pitch of the speech segment, starting from the selected value $F_s$. A mask, denoted a reference mask, is associated with this value. These last-mentioned two steps in the process for the determination of the pitch are represented by block 21 bearing the inscription STM $F_o$ whose output branch supplies the estimated value $\hat{F}_o$ of the pitch.

In a first step of these two steps the harmonic numbers of the reference mask apertures are associated with the significant peak positions $x_i$ coinciding with these apertures. Each of these peak positions $x_i$ will then get a harmonic number $\hat{n}_i$, which defines the location of the peak position in a series of harmonics of the same fundamental tone.

A probable value of $F_o$: $\hat{F}_o$ can be defined as the value for which the deviations between the lastmentioned significant peak positions $x_i$ and the corresponding multiples $\hat{n}_i$. $\hat{F}_o$ of the probable value are as small as possible. When using a m.s.e. criterion (mean square error) for determining the deviations then $F_o$ can be calculated by means of the expression:

$$\hat{F}_o = \sum_{i=1}^{K} x_i \hat{n}_i / \sum_{i=1}^{K} \hat{n}_i^2 \qquad (1)$$

The summation in this expression extends across all significant peak positions coinciding with an aperture of the reference mask the number of which is represented by K.

It will be clear that the value of the pitch associated with the reference mask forms already a first estimation of the pitch sought for. When this estimation is used the last three steps of the above-described process are actually reduced to one step. However, a considerably more accurate estimation is obtained by the use of expression (1).

Some operations of the present system of speech analysis can be implemented in the software of a general-purpose computer. Other operations can be accelerated by the use of external hardware.

Figure 2A:
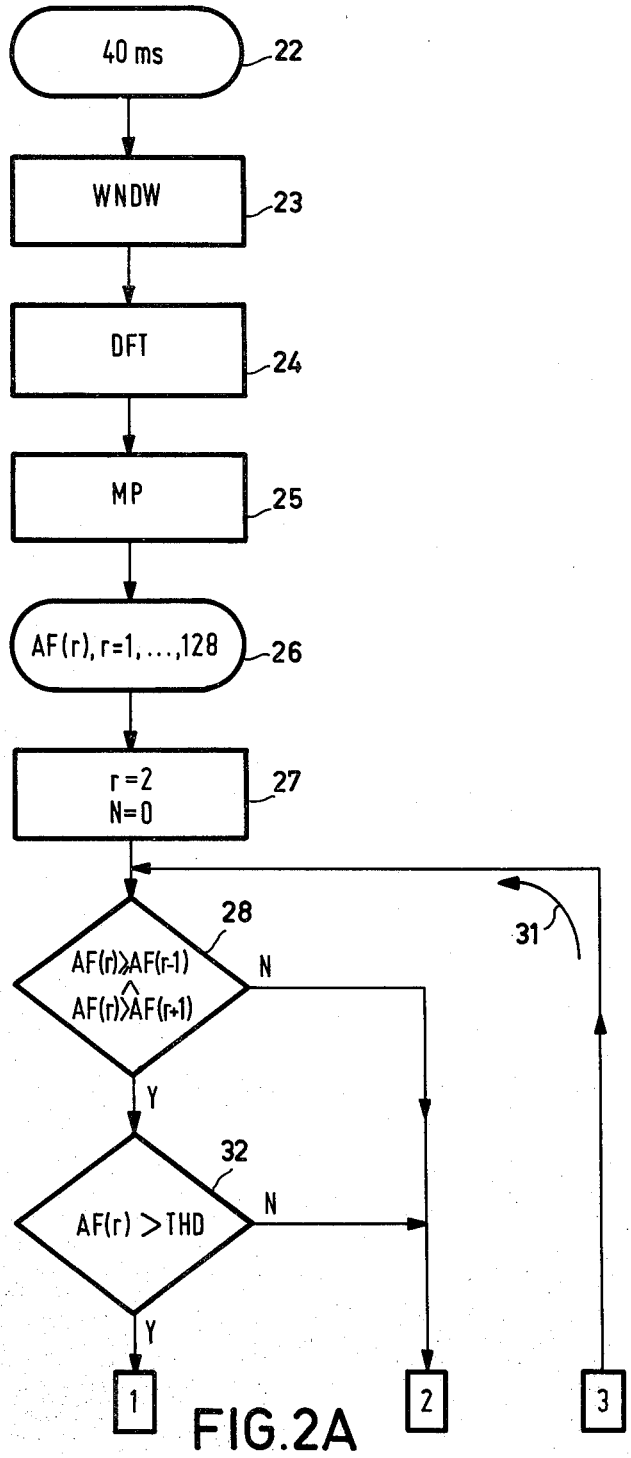
FIG. 2A and 2B illustrate a flow chart of a program of a digital computer for performing certain processes in the speech analysis system shown in FIG. 1.
Figure 2B:
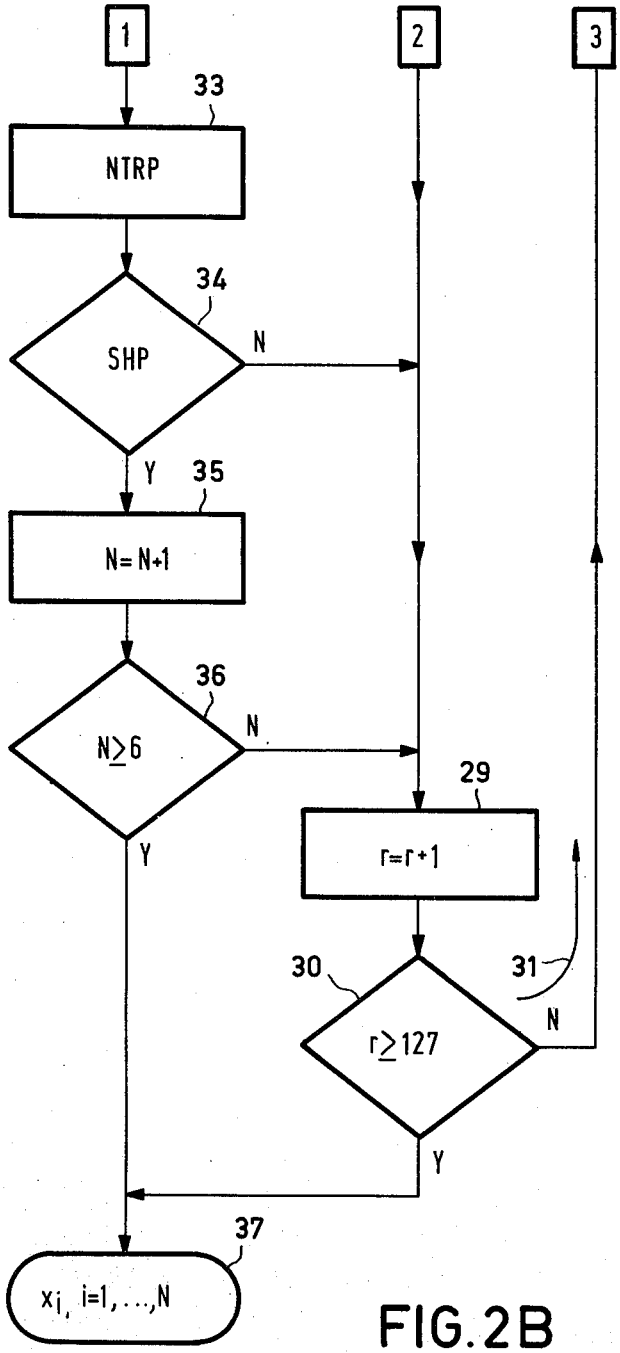

FIGS. 2A and 2B show a flow diagram for the determination of the significant peak positions $x_i$, a function performed in FIG. 1 by block 13.

The blocks 22, 23 and 24 correspond to the blocks 10, 11 and 12, respectively, shown in FIG. 1. The block 25, bearing the inscription MP represents the amplitude determining function of block 13 shown in FIG. 1. The function of the blocks 22–25 can be realized in hardware, using known components. From block 25 onwards the procedure is implemented by the software of a general-purpose computer.

By way of input data the computer receives the components AF(r), r=1, . . . 128 of the amplitude spectrum as represented by block 26.

Initial values for the routine are set at r=2 and N=0. This function is represented by block 27. Starting with spectrum component AF(2) it is then investigated whether this component is greater than or equal to the preceding spectrum component AF(1) and whether spectrum component AF(2) is greater than the next spectrum component AF(3). This function is represented by decision diamond 28. When the spectrum component forms a local maximum, then the Y-branch of diamond 28 is followed.

The N-branch of diamond 28 leads to block 29 which indicates that r must be increased by one. Thereafter it is investigated in decision diamond 30 whether r has become greater or equal to 127. As long as this is not the case a loop 31 is formed to diamond 28. The function of diamond 28 is then repeated with a new value of r.

The Y-branch of decision diamond 28 leads to decision diamond 32 wherein it is investigated whether spectrum component AF(r) exceeds a threshold value THD. If not, the N-branch becomes active and the loop 31 is entered via the blocks 29 and 30 as long as the new value of r is below 127.

The threshold value THD is constituted in the first place by an absolute value which is determined by the level of the noise resulting from the quantization and the "Hamming window."

In the second place a portion of the threshold value THD may be variable to allow for the masking of a spectrum component by the neighbouring spectrum components when these components have a much greater amplitude. This effect occurs in human hearing and is an important factor in pitch perception.

When the Y-branch of decision diamond 32 is followed, an operation is then effected to determine the amplitude and the frequency of the local maximum of the amplitude spectrum, using interpolation between the values AF(r−1), AF(r) and AF(r+1) with a second-order polynomial (parabolic interpolation). This function is represented by block 33 bearng the inscription NTRP.

The next operation relates to a test of the shape of the amplitude spectrum near the local maximum. The regular shape is approximated by the second-order polynomial (parabola) found in the preceding operation. The shape of the local maximum is tested by finding the difference between the spectrum components AF(r−2) and AF(r+2) and the expected values thereof which are positioned on the parabola. A local maximum is considered to be regular when the mean square error is below a predetermined value. The function of testing the shape is represented by decision diamond 34 bearing the inscription SHP.

When the shape of the maximum does not satisfy the shape criterion, the N-branch becomes active and the loop 31 is entered via the blocks 29 and 30. The routine of decision diamond 28 is then repeated with a new value of r.

When the shape of the maximum satisfies the requirement, the Y-branch of decision diamond 34 becomes active and block 35 is entered in which the value of N is increased by one. Thereafter the decision diamond 36 is entered. When N does not exceed a given value, for example six in the present system, then the N-branch becomes active and the loop 31 is entered via the blocks 29 and 30.

The search for local maxima of the amplitude spectrum is continued until not more than the above-mentioned six significant peak positions $x_i$ have been determined. As soon as this is the case the Y-branch of decision diamond 36 becomes active and the significant peak positions $x_i$ are led out (block 37).

The significant peak positions $x_i$ produced by the routine shown in FIGS. 2A and 2B form the input data for the routine shown in FIG. 3.

Figure 3A:
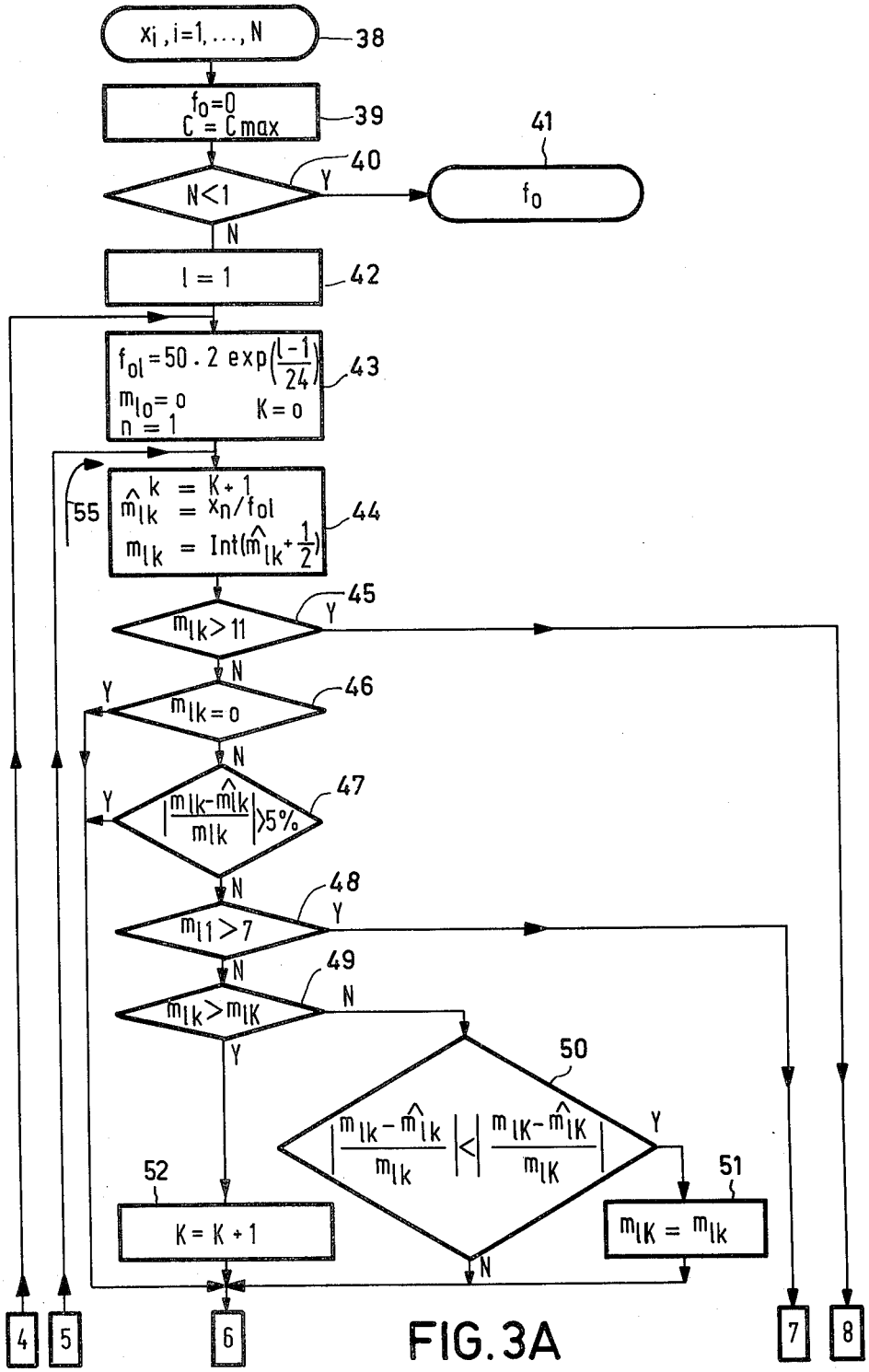
FIG. 3A and 3B illustrate a flow chart for a computer program for implementing certain functions of the flow chart shown in FIG. 1.
Figure 3B:
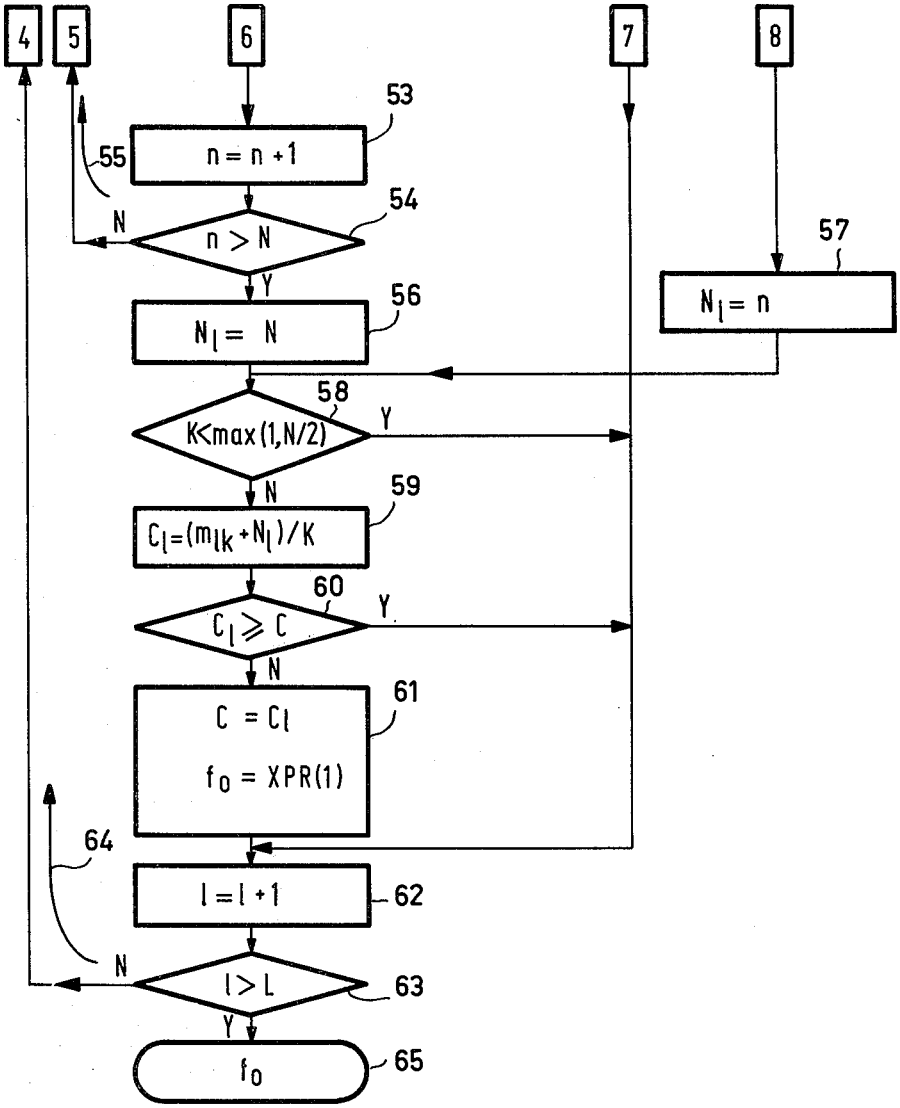

FIGS. 3A and 3B show the flow diagram of a program for the determination of a probable value of the pitch using the mask concept.

By way of input data the program receives the significant peak positions $x_i$, $i=1, \ldots, N$, as illustrated in block 38. They are alternatively denoted as components.

As the initial value for the pitch $f_o$ we choose $f_o=0$ and the variable C is set at the maximum value (block 39).

When the number of offered components is less than one (diamond 40) the routine is left and the value $f_o=0$ is led out (block 41).

If one or more components is let in, the routine is continued.

As a preliminary action the variable 1 which indicates the number of the mask, is set to 1=1 (block 42).

This is followed by the specification of a value of the pitch $f_{01}$ and some variables are set at an initial value (block 43).

In the next operation (block 44) an estimation is made, starting at the first component $x_1$, of the harmonic number $m_{1k}$ associated with the component $x_n$ and this value is rounded to the nearest integral number $m_{1k}$.

When $m_{1k}$ exceeds 11 (decision diamond 45), a large part of the program is skipped because, in the present system of speech analysis, harmonics having a higher number than 11 are not included in the pitch determination.

Thereafter it is checked whether $m_{1k}$ has the value zero (decision diamond 46). If not, then it is checked whether the component $x_i$ falls in an aperture of the mask having the pitch $f_{01}$. If the relative deviation of $x_n$ with respect to the nearest harmonic of the fundamental tone $f_{01}$ is below a given percentage, 5% in the present system, then $x_i$ is considered to be located in the aperture (decision diamond 47).

When the component $x_n$ is located in an aperture of the mask then the N-branch of decision diamond 47 becomes active. Thereafter it is checked whether the first harmonic number of the sequence $m_{1l}$ exceeds 7 (decision diamond 48). If so, a part of the program is skipped because, in the present system of speech analysis, no sequences beginning with such a harmonic number are included in the pitch determination.

When the lowest harmonic number is below or equal to 7 then the N-branch of decision diamond 48 becomes active and the decision diamond 49 is entered.

The next operation relates to the case that for $m_{1k}$ the same value is found as the value $m_{1k}$ (K+1=k) determined previously. For K:1 the value of $m_{1l}$ is compared with $m_{1o}$ as previously set. In this case there are two components in the same aperture of the mask. The present system of speech analysis accepts only the component which is nearest to the centre of the aperture and the other component is not considered.

The variable K counts the number of the components located in an aperture. When $m_{1k}$ exceeds $m_{1K}$ (decision diamond 49) K is thereafter increased by one (block 52).

When, however, $m_{1k}$ does not exceed $m_{1K}$, then it is determined for which of the values $\hat{m}_{1k}$ and $\hat{m}_{1K}$ the smallest deviation occurs with respect to the centre of the aperture (decision diamond 50). When this is the case for $\hat{m}_{1k}$ then $m_{1K}$ is assumed to be equal to $m_{1k}$ (block 51). In the other case $m_{1K}$ is not changed. In both cases K is not increased.

When the program follows the Y-branch of decision diamond 46, the Y-branch of decision diamond 47 or the N-branch of decision diamond 50 or after the operations of the block 51 or 52, the value of n is increased by one (block 53). The variable n counts the offered components $x_i$ and when n is smaller than the total number of offered components (decision diamond 54) the loop 55 is entered.

The described routine then starts again at block 44 for a new value of n. In this manner the routine is repeated for all N components $x_i$.

When n becomes greater than N the Y-branch of decision diamond 54 is followed. Hereafter it is recorded that for the mask having index 1 the number of considered components $N_1$ is equal to N. When the program follows the Y-branch of decision diamond 45, $N_1$ is set equal to n (block 57). Components $x_i$ having a higher index value, have an estimated harmonic number exceeding 11 and are not considered in the pitch determination. In the present system of speech analysis a mask has 11 apertures and components $x_i$ located outside the mask are not included in the pitch determination.

In the next operation it is checked whether at least half of the offered components $x_i$ are passed by the mask (decision diamond 58). This is a not very stringent requirement which excludes in any case the trivial case that $N_1=0$.

The next operation relates to the computation of a quality figure Q which indicates the degree to which the components $x_i$ and the mask apertures match each other.

A quality figure can be derived by assuming the sequence of offered components $x_i$ and the sequence of mask apertures to be vectors in a multi-dimensional space the projections of which vectors on the axes have the values zero or one. The distance between the vectors indicates the degree to which the components $x_i$ and the mask match each other. The quality figure can then be computed as one divided by the distance. Any other expression which is minimal if the distance is minimal and vice versa can be substituted for the distance.

In an elementary manner it can be shown that the distance D can be expressed by $$D = \sqrt{N + M - 2K} \tag{2}$$

wherein N represents the number of components $x_i$, M the number of apertures of the mask and K the number of the components $x_i$ which are located in the mask apertures.

The quality figure Q can be expressed as:

$$Q = \frac{1}{D^2} = \frac{1}{N + M - 2K} \tag{3}$$

The distance D can be normalized by dividing it by the length of the unity vector:

$$E = \sqrt{N + M - K} \tag{4}$$

This would result in the quality figure:

$$Q = \frac{E^2}{D^2} = \frac{N + M - K}{N + M - 2K} \tag{5}$$

After elementary operations it can be shown that Q is at its maximum in accordance with expression (5) when Q' in accordance with the expression:

$$Q' = \frac{K}{N + M} \tag{6}$$

is at its maximum. It is then permitted to replace Q by Q'.

Another quality figure can be based on the angle between the two vectors. It can be shown in an elementary manner that the angle is minimal when Q'' in accordance with the expression:

$$Q'' = \frac{K^2}{N \cdot M} \tag{7}$$

is at its maximum.

Components $x_i$ falling outside the mask do not contribute towards the value of K although they may have a harmonic relationship with the fundamental tone of the mask. A more suitable quality figure will be obtained when in the expressions for Q the quantity N is replaced by $N_1$ which indicates the number of components located within the range of the mask.

It may happen that apertures of the mask fall outside the range of the offered components $x_i$ and therefore do not pass a component. The quality figure can be corrected for this situation by replacing in the expression for Q the quantity M by $m_{1K}$, this being the highest number of the apertures which pass a component.

In the operation shown in FIGS. 3A and 3B, a quantity $C_1$, which is the inverse of the quality figure Q in accordance with expression (6) wherein N is replaced by $N_1$ and M by $m_{1K}$ (block 59), is computed after the N-branch of decision diamond 58 has become active.

In the next operation it is checked whether $C_1$ exceeds the value of the variable C. (decision diamond 60). If not then the value $C_1$ is assigned to C. This means that the present mask has a better fit than the previous mask. The pitch $f_o$ is now computed in accordance with expression (1)(block 61).

After the operation of block 61 or when the program follows the Y-branch of decision diamond 58 or the Y-branch of decision diamond 60, the index 1 of the of the mask is increased by one (block 62). If 1 is smaller than the total number of masks L, (decision diamond 63) the loop 64 is entered and the described routine is repeated with a new value of 1 until all masks have been processed.

When 1 becomes greater than L the Y-branch of decision diamond 63 becomes active and the last-computed value of $f_o$ is led out (block 65).

The present system of speech analysis can be implemented by the software of a general-purpose digital computer or partly in external hardware and the remaining part in software.

Figure 4A:
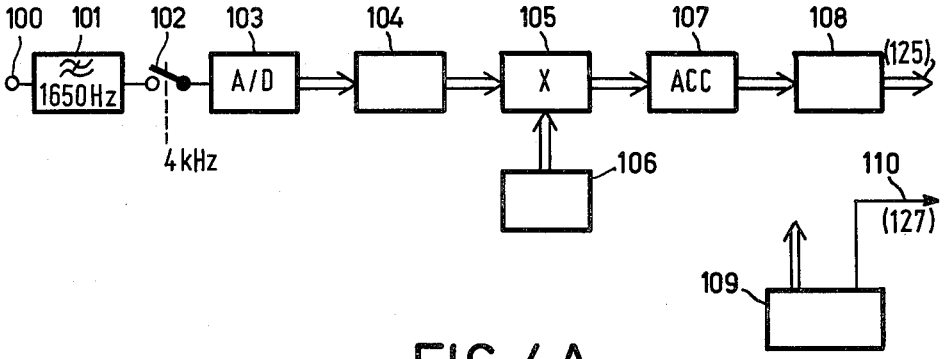
FIGS. 4A and 4B show a schematic block diagram of electronic equipment for the implementation of the present speech analysis system.
Figure 4B:
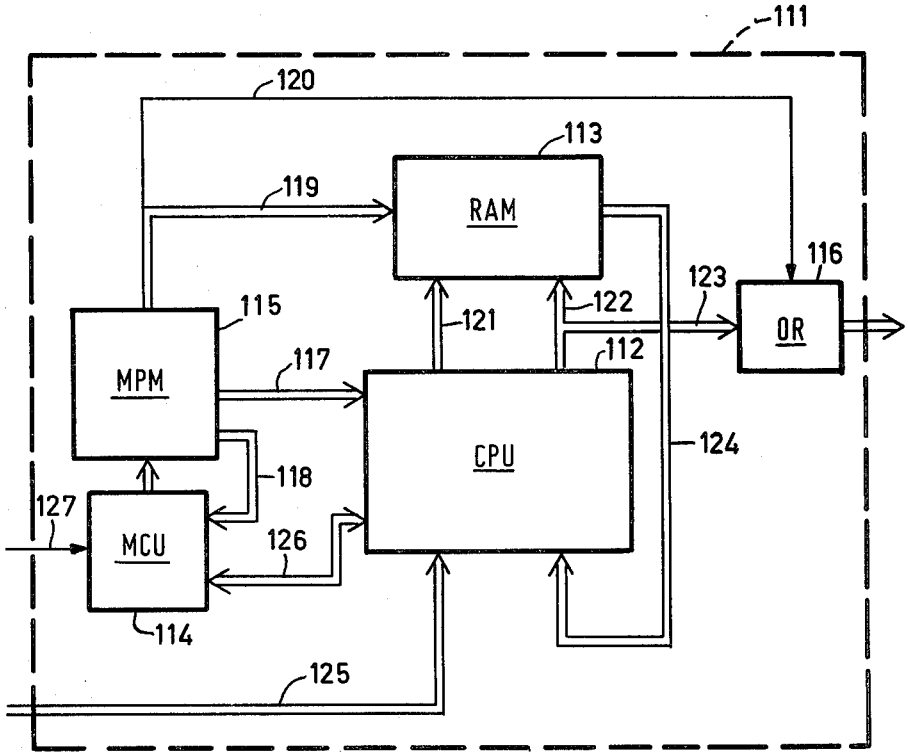

An example of the hardware suitable for use in the implementation of the present system of speech analysis is illustrated in FIGS. 4A and 4B.

This equipment receives an analog speech signal (input 100) as an input signal. This signal is filtered in a low-pass filter 101 and is then sampled by a sampling switch 102 operating with a sampling frequency of 4 kHz.

The next operation is the analog-to-digital conversion of the samples of the speech signal in A/D convertor 103. The coded signal samples are stored in a buffer store 104 having a capacity of 200 samples. Computing the pitch requires, for example, 10 ms whereas a 40 ms speech segment is used for each computation. The buffer store 104 must then have a capacity suitable for 50 ms of speech or 200 samples.

By means of a discrete Fourier transform (DFT) 64 frequency points of the amplitude spectrum are computed from the 160 most recent samples $a_i$, $i=1, \ldots, 160$. These points are located at the frequencies $(25+k.25)$Hz, $k=1, 2, \ldots 64$.

The coefficients of the DFT are:

$c_{ik}=\cos\,[2\pi(k+1)(i-80,5)/160]$ $s_{ik}=\sin\,[2\pi(k+1)(i-80,5)/160]$

Multiplication by the "Hamming window" is effected by multiplying the coefficients of the DFT by the "Hamming window" in accordance with the factors:

$$H_i = 0{,}54 + 0{,}46 \cos [2\pi(i - 80{,}5)/160]$$

Each frequency point consists of a real portion $FR_k$ and an imaginary portion $FI_k$ which are computed as follows $$FR_k = \sum_{i=1}^{160} a_i * c_{ik} * H_i$$

$$FI_k = \sum_{i=1}^{160} a_i * s_{ik} * H_i$$

These operations are performed by a multiplier 105 and a coefficients store 106 (ROM) in combination with an accumulator 107.

To compute the 64 frequency points the multiplier 105 must perform 20480 multiplications. For a multiplication time of 150 ns the total computation occupies 3.072 ns. A suitable multiplier is the type MPY-12AJ marketed by TRW.

The computed values of the frequency points are stored in a buffer store 108. When the spectrum has been computed, a clock pulse generator 109 generates an interrupt signal at an output 110 which is connected to the interrupt input of the microcomputer which is shown in the block 111.

The output of the buffer store 108 is connected to the data input of the microcomputer which, after receipt of an interrupt signal, transfers the values from the buffer store 108 to the internal store of the microcomputer.

The microcomputer is based on the Signetics 3000 microprocessor and comprises a central processing unit (CPU) 112, a random access memory (RAM) 113, a micro control unit (MCU) 114, a micro program memory (MPM) 115 and an output register (OR) 116.

During the execution of a program, MCU 114 generates addresses for MPM 115, which supplies instructions to CPU 112 (line 117) and feeds data about the next instruction back to MCU 114 (line 118).

For the benefit of input/output control, MPM 115 supplies control bits to RAM 113 (line 119) and to the output register (OR) 116 (line 120).

The CPU 112 supplies addresses (line 121) and data (line 122) to RAM 113 and supplies data to OR 116 (line 123) and receives data from RAM 113 (line 124) and from the data input (line 125).

The MCU 114 exchanges flag and carry information with CPU 112 (line 126) and receives the interrupt signal (line 127).

This microcomputer can be programmed by those skilled in the art in accordance with the flow diagrams contained in the FIGS. 5A–5D, using the information for users supplied by the manufacturer of the microprocessor.

Loaded with this program the microcomputer supplies a value for $\hat{F}_o$ at the output after receipt of an interrupt signal from clock pulse generator 109. This value is renewed after each interrupt signal produced by clock pulse generator 109. These interrupt signals may occur after every 10 ms which period of time is sufficient for the microcomputer to compute the pitch.

Figure 5A:
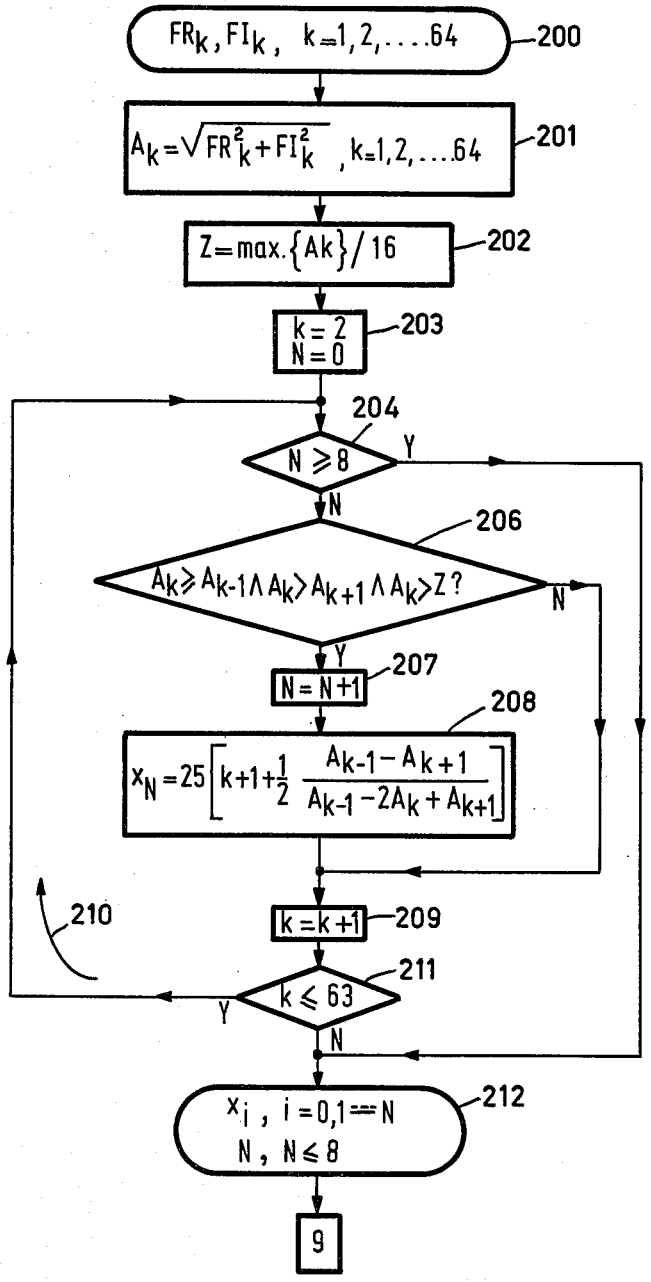
FIGS. 5A, 5B, 5C and 5D illustrate a flow chart of a program which can be performed by the micro-processor section of the equipment shown in FIGS. 4A and 4B for effecting certain operations in the present speech analysis system.
Figure 5B:
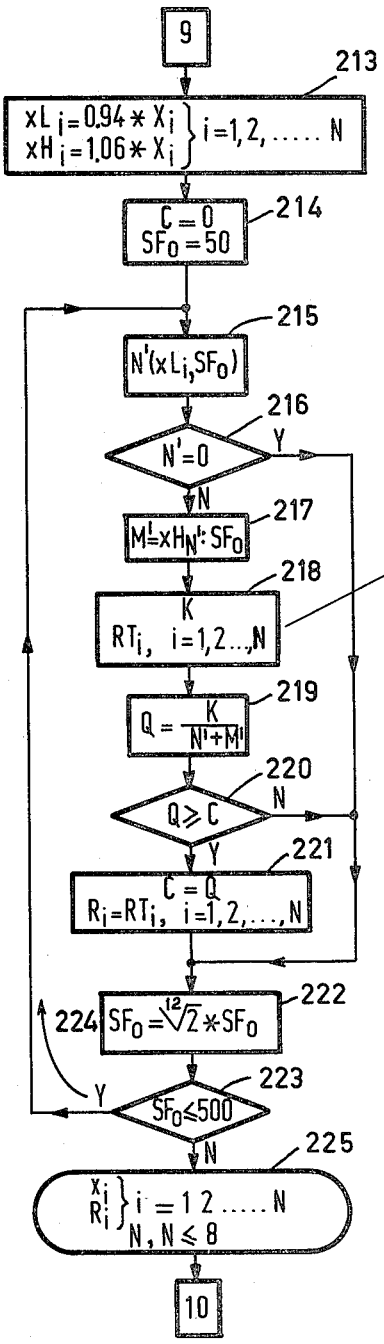

After an interrupt signal the microcomputer receives by way of input data the values of the frequency points $FR_k$ and $FI_k$, k=1, . . . 64 (block 200, FIG. 5A).

The next operation consists of the determination of the value of the amplitude (block 201). Thereafter a threshold value Z is determined which is equal to a fraction of the maximum amplitude (block 202).

Thereafter the value of the variable k which represents the index of the components $A_k$ of the amplitude spectrum is set at 2 and the number N of the significant peak position $x_i$ is put at zero (block 203).

In the next operation it is first checked whether the maximum number of 8 significant peak positions has already been reached (block 204). If not, it is checked whether the amplitude value $A_k$ forms a local maximum exceeding the threshold Z (decision diamond 206).

If this is the case the Y-branch of decision diamond 206 becomes active and N is increased by one (block 207).

The proper position of the local maximum in the spectrum is computed by interpolation by means of a second-order polynomial between the components $A_k$, $A_{k-1}$ and $A_{k+1}$ (block 208). This routine supplies the position $x_i$ of the significant peak in the amplitude spectrum. Hereafter the index k is increased by one (block 209) and the loop 210 is entered when the new value of k is still smaller than or equal to 63 (decision diamond 211).

When component $A_k$ does not form a local maximum the N-branch of decision diamond 206 becomes active and N is not increased by one. In this case k is increased by one (block 209).

When loop 210 is followed the described routine repeats itself from decision diamond 204 onwards for the new value of k until all components $A_k$, the last one excepted, have been processed.

If decision diamond 211 detects that the new value of k is 64 then the N-branch becomes active and the significant peak positions $x_i$ are led out (block 212), if it was not already detected at an earlier instant that eight significant peak positions were found (decision diamond 204). In the last-mentioned case the Y-branch of decision diamond 204 becomes active and the eight significant peak positions $x_i$ are thereafter led out.

The significant peak positions $x_i$ form the input data for the next routine by means of which the harmonic numbers $R_i$ of the components $x_i$ are determined. Hereinafter these input data are denoted as components $x_i$.

Unlike the routine shown in FIGS. 3A and 3B, a mask is formed here having apertures around the components $x_i$. Thereafter it is checked for which value of the pitch the best fit is obtained between the mask and the sequence of harmonics of the pitch. This alternative method has computational advantages and produces the same result as the previous method.

For each value of $x_i$ a lower value $xL_i$ and a higher value $xH_i$ are computed which together define an aperture around the component $x_i$ (block 213). The sequence of apertures for all components $x_i$ forms the reference mask.

Before the beginning of the main loop of the routine the variable C which registers the quality figure is adjusted to zero and an initial value (50 Hz) is adjusted for the pitch $SF_o$ (block 214).

The sequence of harmonics of the selected pitch initially always comprises eight components. Thereafter the number N' of the components $x_i$ which are located within the range of the sequence of harmonics is determined, that is to say the number of component $x_i$ for which $xL_1$ is smaller than eight times the selected value of the pitch $SF_o$ (block 215).

When N' exceeds zero (decision diamond 216) the number M' of the harmonics of the selected pitch $SF_o$ located within the range of the components $x_i$ is determined, wherein M' is the result in an integral number of the quotient $xH_N/SF_o$.

In the next operation the number K of the harmonics of the selected pitch located in the apertures of the mask is determined, a provisional harmonic number $RT_i$ being associated with each component $x_i$. If no harmonic of the pitch is located in an aperture, the relevant components $x_i$ are given the harmonic number zero. In the case a harmonic of the selected pitch is located in the apertures of more than one component $x_i$ the harmonic number is allotted to the component $x_i$ having the lowest value (block 218).

Figure 5D:
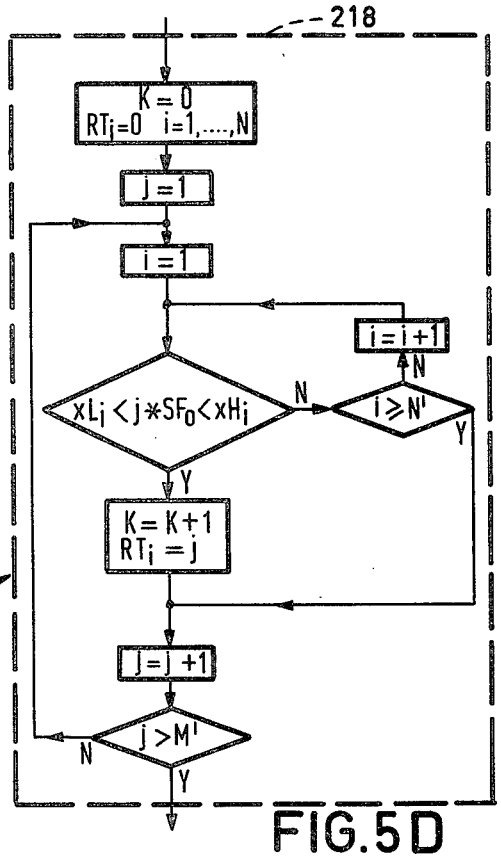
Figure 5C:
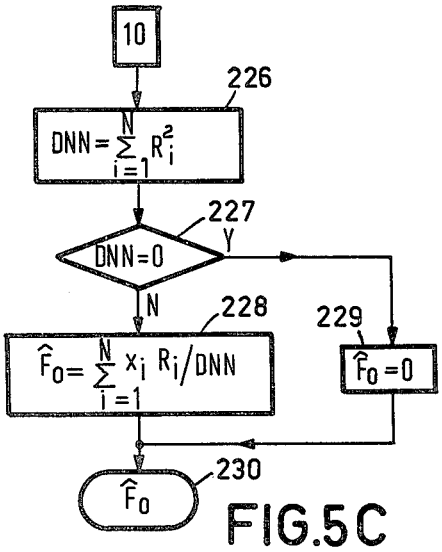

FIG. 5D shows the routine of block 218 in greater detail, the operation thereof can be derived from the Figure.

The operation of block 218 is followed by the computation of the quality figure Q associated with the selected value of the pitch $SF_o$ (block 219).

Thereafter it is determined whether the quality figure Q is greater than or equal to the value found previously (decision diamond 220). If so, the variable C is made equal to Q and the provisional numbers $RT_i$ are taken over by the variables $R_i$ which record the new harmonic numbers (block 221).

When the routine follows the Y-branch of decision diamond 216 or the N-branch of decision diamond 220 or after the operation of block 221 a new initial value for the pitch $SF_o$ is computed (block 222).

The routine enters the loop 224 when the new value of the pitch is still smaller or equal to 500 Hz (decision diamond 223). The described routine is then repeated from block 215 for the new value of the pitch $SF_o$.

When, after the loop 224 has been passed through a number of times, the new value of the pitch $SF_o$ becomes greater than 500 Hz (decision diamond 223), the loop is left and the components $x_i$ with the associated harmonic numbers $R_i$ are led out (block 225).

The components $x_i$ and the numbers $R_i$ constitute the input data for a routine for computing the probable value of the pitch $\hat{F}_o$ (similar to expression (1)).

This procedure starts with the computation of a quantity DNN which is formed by the sum of the squares of the harmonic numbers (block 226). When this quantity is not equal to zero (decision diamond 227) then $\hat{F}_o$ is computed in block 228. In the other case the Y-branch of decision diamond 227 is followed and $\hat{F}_o$ is set to zero (block 229). In both cases the routine ends by leading the value of the pitch $\hat{F}_o$ out (block 230).

The quality figure Q which is computed in block 219 can of course be computed in accordance with one of the other expressions without deviating from the described operating principle.

The two processes for comparing the significant peak positions with sequences of harmonics of a fundamental tone, using the mask concept, which is defined in the first case by the sequence of harmonics of the fundamental tone and in the second case by the significant peak positions furnish the same result. Each of these procedures may be considered as the dual case of the other, having the same advantages as regards the insensitivity to noise components.

What is claimed is:

1. In a system of speech analysis used, for example, in a vocoder in which the pitch value of human speech is determined and subsequently transmitted together with other speech parameters to the receiving section of another vocoder wherein the speech is synthesized and reproduced, a method for determining the pitch of a speech signal comprising the steps:

analyzing the amplitude of said speech signal by regularly selecting time segments of the speech signal, determining from each time segment a sequence of spectrum components which constitutes the descrete Fourier transform of samples of the speech signal, and deriving in each time segment the position of the significant peaks in the spectrum from the sequence of spectrum components;

selecting a starting value for the pitch, determining a sequence of consecutive integral multiples of said pitch value, and establishing intervals around said pitch value and multiples thereof, said intervals defining a mask having apertures in situ of said intervals, harmonic numbers corresponding to the multiplication factors in said multiples being associated respectively with said apertures;

determining the number of said significant peak positions which coincide with said mask apertures;

computing a quality figure in accordance with a criterion indicating the degree to which said significant peak positions and said mask apertures match;

repeating said immediately preceding determining and computing steps using masks, as determined in said selecting step, for consecutively higher values of pitch up to a predetermined highest value of pitch, resulting in the computing of separate quality figures associated with each of said pitch values;

selecting the value of pitch having the highest associated quality figure and designating the associated mask as a reference mask;

associating the harmonic numbers of the apertures of said reference mask with the significant peak positions coinciding with said apertures, thereby defining the location of each of said significant peak positions in a sequence of harmonics of a same fundamental tone;

determining a probable value for the pitch of the speech signal, wherein the deviations between the significant peak positions and the corresponding multiples of the probable value having the same harmonic numbers are as small as possible, and combining said determined pitch value with other speech parameters for subsequent transmission or storage thereof in, for example, a read-only-memory.

2. A method for determining the pitch of a speech signal as claimed in claim 1, characterized in that the step of computing the quality figure Q uses one of the expressions:

$$Q = \frac{K}{M+N}\,;\; Q = \frac{K^2}{M \cdot N}\,;\; Q = \frac{1}{M+N-2K}$$

wherein K represents the number of significant peak positions coinciding with apertures of the mask, M representing the number of apertures of the mask and N the number of significant peak positions.

3. A method for determining the pitch of a speech signal as claimed in claim 2, characterized in that in the step of computing the quality figure, M' is substituted for the quantity M in the expressions for the quality figure Q, wherein M' is equal to M reduced by the number of apertures located outside the range of the significant peak positions.

4. A method for determining the pitch of a speech signal as claimed in claim 2, characterized in that in the step of computing the quality figure, in the expressions for the quality figure Q the quantity N is replaced by N' which is equal to N reduced by the number of significant peak positions which are located outside the range of the mask apertures.

5. A method for determining the pitch of a speech signal as claimed in claim 1, characterized in that the step of determining the probable value of the pitch $F_o$ uses the expression:

$$\hat{F}_o = \sum_{i=1}^{K} x_i * \hat{n}_i \Big/ \sum_{i=1}^{K} \hat{n}_i^2$$

wherein $x_i$ represents the $i^{th}$ significant peak position and $n_i$ the harmonic number associated therewith and wherein K represents the number of significant peak positions which coincide with apertures of the mask.

6. In a system of speech analysis used, for example, in a vocoder in which the pitch value of human speech is determined and subsequently transmitted together with other speech parameters to the receiving section of another vocoder wherein the speech is synthesized and reproduced, a method for determining the pitch of a speech signal comprising the steps:

analyzing the amplitude of said speech signal by regularly selecting time segments of the speech signal, determining from each time segment a sequence of spectrum components which constitutes the discrete Fourier transform of samples of speech signal, and deriving in each time segment the position of the significant peaks in the spectrum from the sequence of spectrum components;

selecting an initial value for the pitch and determining a sequence of consecutive integral multiples of this pitch value, harmonic numbers corresponding to the multiplication factor in said multiples being associated respectively with said multiples of said pitch value;

establishing intervals around the significant peak positions, said intervals defining a mask having apertures in situ of said peak positions;

determining the number of multiples of said pitch value which coincide with said mask apertures;

computing a quality figure in accordance with a criterion indicating the degree to which said multiples of said pitch value and said mask apertures match;

repeating said immediately preceding determining and computing steps using consecutively higher values of pitch and multiples thereof, as determined in said selecting step, up to a predetermined highest value, resulting in the computing of separate quality figures associated with each of said pitch values;

selecting the value of pitch having the highest associated quality figure and designating this pitch value as a reference pitch value;

associating the harmonic numbers of the multiples of the reference pitch value with the significant peak positions located in the same aperture, thereby defining the location of said significant peak positions in a sequence of harmonics of the same fundamental tone;

determining a probable value for the pitch of the speech signal, wherein the deviations between the significant peak positions and the corresponding multiples of the probable value having the same harmonic numbers are as small as possible; and combining said determined pitch value with other speech parameters for subsequent transmission or storage thereof in, for example, a read-only-memory.

7. A method as claimed in claim 6 characterized in that the step of computing the quality figure Q uses one of the expressions:

$$Q = \frac{K}{M+N}\,;\; Q = \frac{K^2}{M \cdot N}\,;\; Q = \frac{1}{M+N-2K}$$

wherein K represents the number of multiples of the pitch which coincide with an aperture of the mask, wherein M represents the number of multiples of the pitch of the sequence and N the number of significant peak positions.

8. A method as claimed in claim 7, characterized in that in the step of computing the quality figure, M' is substituted for the quality M in the expression for the quality figure Q, wherein M' is equal to M reduced by the number of multiples of the pitch which are located outside the range of the significant peak positions.

9. A method as claimed in claim 7, characterized in that in the step of computing the quality figure, in the expressions for the quality figure Q the quantity N is replaced by N' which is equal to N reduced by the number of significant peak positions which are located outside the range of the sequence of multiples of the pitch.

10. A method as claimed in claim 2, characterized in that the step of determining the probable value of the pitch $F_o$ uses the expression:

$$\hat{F}_o = \sum_{i=1}^{N} x_i * R_i \Big/ \sum_{i=1}^{N} R_i^2$$

wherein $x_i$ represents the value of the $i^{th}$ significant peak position and $R_i$ the harmonic number associated therewith wherein N represents the number of significant peak positions and therein the number zero is associated with a significant peak position when no multiple of the selected pitch is located in the relevant mask aperture.

* * * * *